US007943011B2

(12) United States Patent
Reed et al.

(10) Patent No.: US 7,943,011 B2
(45) Date of Patent: May 17, 2011

(54) PAPERBOARD MATERIAL WITH EXPANDED POLYMERIC MICROSPHERES

(75) Inventors: David V. Reed, Blanchester, OH (US); Gregory Wanta, Collierville, TN (US); Gary W. Nyman, Shanghai (CN); Douglas W. Wadley, Texarkana, TX (US)

(73) Assignee: International Paper Company, Memphis, TN (US)

( * ) Notice: Subject to any disclaimer, the term of this patent is extended or adjusted under 35 U.S.C. 154(b) by 744 days.

(21) Appl. No.: 11/800,911

(22) Filed: May 7, 2007

(65) Prior Publication Data

US 2007/0256805 A1 Nov. 8, 2007

Related U.S. Application Data

(60) Provisional application No. 60/798,202, filed on May 5, 2006.

(51) Int. Cl.
*D21F 11/00* (2006.01)

(52) U.S. Cl. ..... 162/202

(58) Field of Classification Search ..... 162/202, 162/135, 169, 134, 164.1, 158; 428/34.2, 428/35.6, 141

See application file for complete search history.

(56) References Cited

U.S. PATENT DOCUMENTS

| | | | |
|---|---|---|---|
| 3,556,934 | A | 1/1971 | Meyer |
| 3,615,972 | A | 10/1971 | Morehouse, Jr. et al. |
| 3,864,181 | A | 2/1975 | Wolinski et al. |
| 4,006,273 | A | 2/1977 | Wolinski et al. |
| 4,044,176 | A | 8/1977 | Wolinski et al. |
| 4,477,518 | A | 10/1984 | Cremona et al. |
| 5,101,600 | A | 4/1992 | Morris et al. |
| 5,139,538 | A | 8/1992 | Morris et al. |
| 5,662,761 | A | 9/1997 | Middelman et al. |
| 6,007,320 | A | 12/1999 | Froese et al. |
| 6,228,200 | B1 | 5/2001 | Willis et al. |
| 6,379,497 | B1 | 4/2002 | Sandstrom et al. |
| 6,497,790 | B2 | 12/2002 | Mohan et al. |
| 6,617,364 | B2 | 9/2003 | Soane et al. |
| 6,630,232 | B1 | 10/2003 | Muser et al. |
| 6,701,637 | B2 | 3/2004 | Lindsay et al. |
| 6,802,938 | B2 | 10/2004 | Mohan et al. |
| 6,846,529 | B2 | 1/2005 | Mohan et al. |
| 7,018,509 | B2 | 3/2006 | Kilgannon et al. |
| 2001/0044477 | A1 | 11/2001 | Soane et al. |
| 2002/0152630 | A1 | 10/2002 | Lindsay et al. |
| 2003/0003268 | A1 | 1/2003 | Williams et al. |
| 2003/0008931 | A1 | 1/2003 | Soane et al. |
| 2003/0008932 | A1 | 1/2003 | Soane et al. |
| 2003/0213544 | A1 | 11/2003 | Hesch |
| 2004/0157057 | A1 | 8/2004 | Tasaki et al. |
| 2005/0098286 | A1 | 5/2005 | Williams et al. |
| 2006/0231227 | A1 | 10/2006 | Williams et al. |
| 2007/0044929 | A1 | 3/2007 | Mohan et al. |

FOREIGN PATENT DOCUMENTS

| | | |
|---|---|---|
| EP | 0190788 | 4/1990 |
| EP | 0432355 | 6/1991 |
| EP | 0486080 | 1/1996 |
| EP | 0700237 | 3/1996 |
| EP | 0598372 | 8/1997 |
| EP | 0651696 | 8/1998 |
| EP | 0751866 | 4/1999 |
| EP | 1531198 | 5/2005 |
| JP | 2000-000084 | 1/2000 |
| JP | 2000-272062 | 10/2000 |
| JP | 2001-129919 | 5/2001 |
| WO | WO 92/22191 | 12/1992 |
| WO | WO 93/23614 | 11/1993 |
| WO | WO 95/20479 | 8/1995 |
| WO | WO 97/19127 | 5/1997 |
| WO | WO 01/79600 | 10/2001 |
| WO | WO 02/086234 | 10/2002 |

*Primary Examiner* — Mark Halpern
(74) *Attorney, Agent, or Firm* — Matthew M. Eslami

(57) ABSTRACT

The present invention is related to a paperboard product having a basis weight in a range of 100 to 350 pounds per 3,000 square feet. The paperboard comprises at least one coated surface suitable for printing. The at least one coated surface comprising cellulosic fibers and from about 0.05 to about 0.5 wt. % dry basis expanded synthetic polymer microspheres based on total weight of the of cellulosic fiber dispersed thereof. The coated surface has a Parker smoothness less than about 2.0 and a Hagerty/Sheffield smoothness not less than about 20 Sheffield units.

16 Claims, 3 Drawing Sheets

PAPERBOARD MATERIAL WITH EXPANDED POLYMERIC MICROSPHERES

FIELD OF THE INVENTION

This invention relates generally to the production of articles from low density paper or paperboard and to insulated articles made therefrom, and in particular, relates to cups and folding carton made of low density paper and paperboard with improved printing surface and qualities.

BACKGROUND OF THE INVENTION

Paperboard is used to create packages for a variety of consumer products such as pharmaceuticals, home entertainment, health and beauty aids, food, and tobacco products. Insulated cups and folding containers are widely used for serving hot and cold beverages and other food items. Such articles may be made from a variety of materials including polystyrene foam, double-walled containers, and multi-layered paper-based containers such as paperboard containers containing an outer foamed layer. Paper-based containers are often more desirable than containers made from styrene-based materials because paper-based materials are generally more amenable to recycling, are biodegradable and have a surface more acceptable to printing. However, multi-layered and multi-walled paper-based containers are relatively expensive to manufacture compared to polystyrene foam-based articles and often do not exhibit comparable insulative properties. Paperboard containers having an outer foam insulation layer are generally less expensive to produce than double-walled containers, but the outer surface is less compatible with printing.

Print mottle is an undesirable quality in offset printing. Specifically back trap print mottle is observed in coated paperboard and other coated substrates when the print from the previous station comes in contact with the subsequent stations which can range from two additional stations to as many as six or more additional stations. This print mottle can be caused by variety of reasons, including, binder migration during the drying of the coating process, poor basesheet formation and non-uniform coat weight distribution. Print mottle reduction may involve controlling the drying strategies after coating, which may limit the productivity and require additional capital to overcome them. Any method that can reduce the print mottle can be useful in generating an aesthetically appealing product.

A low-density coated paperboard with improved mottle is desirable from an aesthetic and economic perspective. A reduction in paperboard density results in a more economical product requiring less material and energy input to produce an equal area of paperboard. The print characteristics of coated paperboard are dependent on a complex interaction of basesheet structure, coating properties and lay down, and the finishing process of the coated product. In an ideal situation, a well formed basesheet (good formation) is lightly finished before calendering (to minimize densification) and the coating formulation and equipment allow a uniform coating distribution that is then finished to give a smoother surface without much further densification. In practice, this is difficult to achieve, with formation of baseheets being in regimes such that excessive calendering is required to achieve target smoothness levels before coating. Densification of the paperboard is not desirable from a cost of manufacture perspective. Further, excessive densification of the basesheet can contribute to nonuniform binder migration, which could contribute to print mottle. Existing methods of correcting densification of basesheet include 1) multiply machines with bulky fibers, such as BCTMP and other mechanical fibers in the center plies of paperboard, 2) use of extended nip press sections for reducing densification during water removal, and 3) alternate calendering technologies for basestock, including hot soft calendering, hot steel calendering, steam moisturization, shoe nip calendering. These options typically require significant capital and can be economically prohibitive. If the basestock is not finished to target smoothness, higher coat weights need to be used for achieving desirable print quality. While the basestock density may be lower in this case, the coating cost would increase significantly and increase the overall cost and increase the density of the final product.

Therefore, there is a need for a method and an apparatus to reduce the density of coated paperboard with improved or desirable smoothness and print quality.

SUMMARY OF THE INVENTION

The basestock of the coated paperboard is modified to improve the offset print performance of the paperboard. Specifically, one or more advantages of the present invention is a reduced density basestock with decreased print mottle of the printed substrate can be produced with existing furnish, process and equipment. Similarly, if the current level of mottle is acceptable, the basis weight of the paperboard can be reduced resulting in a more economical product. Another advantage of the present invention is that expandable microspheres can be used to reduce the density of paperboard while maintaining paperboard stiffness and improve the compressibility characteristics of the paperboard to enable improvement in print mottle in offset printing. A further advantage of the present invention is that a significant reduction of expandable microspheres needed to achieve the target properties as a weight percent per ton of basis weight of paperboard.

Accordingly, the present invention is directed to a paper or paperboard substrate comprising cellulosic fibers and from about 0.05 to about 0.5 wt. % dry basis expanded synthetic polymer microspheres based on total weight of the substrate dispersed in the cellulosic fibers. The substrate comprises at least one surface suitable for printing. The surface comprises a Parker smoothness less than about 5.0, a Hagerty/Sheffield smoothness of less than about 180 Sheffield units or a combination thereof.

Further, the present invention is related to a paperboard product having a basis weight in a range of 100 to 350 pounds per 3,000 square feet. The paperboard comprises at least one coated surface suitable for printing. The at least one coated surface comprising cellulosic fibers and from about 0.05 to about 0.5 wt. % dry basis expanded synthetic polymer microspheres based on total weight of the of cellulosic fiber dispersed thereof. The coated surface has a Parker smoothness less than about 2.0, a Hagerty/Sheffield smoothness not less than about 20 Sheffield units or a combination thereof.

Furthermore, the present invention is related to a method for making a paper or paperboard substrate which comprises providing a papermaking furnish containing cellulosic fibers and from about 0.05 to about 0.5 wt % by weight dry basis expanded or expandable microspheres; forming a fibrous substrate from the papermaking furnish; increasing smoothness of a paperboard substrate by moving the fibrous substrate through at least one press belt or press felt device or combination thereof to form a pressed paperboard substrate; increasing heat transfer rate between the pressed paperboard substrate and a drying device of a paper machine by using the press belt or the press felt; and reducing the amount of the expanded polymeric microspheres used in the paperboard substrate.

BRIEF DESCRIPTION OF THE DRAWINGS

A full understanding of the invention can be gained from the following description of the preferred embodiments when read in conjunction with the accompanying drawings in which.

DETAIL DESCRIPTION OF THE INVENTION

Figure 1:
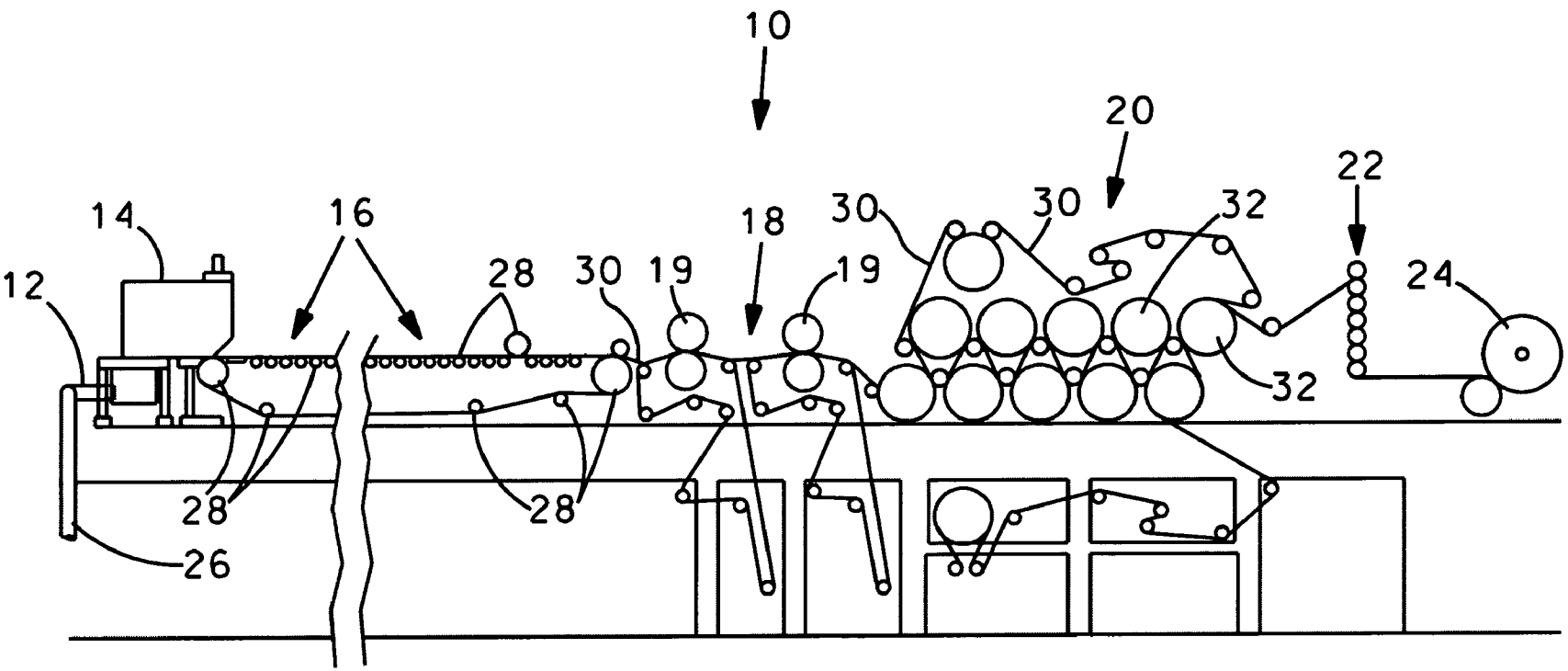
FIG. 1 is a schematic view of a paper machine having at least one press belt in the press section to form a paperboard substrate in accordance with the preferred embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the paperboard aspect of the invention to the embodiments illustrated.

Containers such as cups or folding carton are widely used for dispensing hot and cold beverages. Paperboard substrates coated with an insulating layer often provide acceptable insulative properties, however, the outer layer is usually a foamed thermoplastic polymeric layer which raises the cost and is difficult to print. Corrugated and double-walled paperboard containers also generally provide suitable insulative properties, but are more complex and expensive to manufacture than single ply containers. Both of these alternatives use more material in their construction, thus they have more of an environmental impact. Until now, it has been difficult to produce an economical insulated container made substantially of paperboard which has the required strength for convertibility, exhibits insulative properties, and contains a surface which is receptive to printing.

The present invention provides an improved low density paperboard material having insulative properties suitable for hot and cold beverage containers, and which has the strength properties necessary for conversion to cups in a cup forming operation. The low density paperboard material is made by providing a papermaking furnish containing hardwood fibers, softwood fibers, or a combination of hardwood and softwood fibers. A preferred papermaking furnish contains from about 60 to about 80 percent by weight dry basis hardwood fiber and from about 20 to about 40 percent by weight dry basis softwood fiber. Preferably, the fibers are from bleached hardwood and softwood kraft pulp. The furnish also contains from about 0.25 to about 10 percent by dry weight basis expandable microspheres, preferably in an unexpanded state. Most preferably, the microspheres comprise from about 2 to about 5 percent by weight of the furnish on a dry basis. Other conventional materials such as starch, fillers, sizing chemicals and strengthening polymers may also be included in the papermaking furnish. Among the fillers that may be used are organic and inorganic pigments such as, by the way of example only, polymeric particles such as polystyrene latexes and polymethylmethacrylate, and minerals such as calcium carbonate, kaolin, and talc.

The production of paper containing expandable microspheres is generally described, for example, in U.S. Pat. No. 6,846,529, U.S. Pat. No. 6,802,938, U.S. Pat. No. 3,556,934 to Meyer, the disclosures of which is incorporated by reference as if fully set forth herein. Suitable expandable microspheres include synthetic resinous particles having a generally spherical liquid-containing center. The resinous particles may be made from methyl methacrylate, methyl methacrylate, ortho-chlorostyrene, polyortho-chlorostyrene, polyvinylbenzyl chloride, acrylonitrile, vinylidene chloride, para-tert-butyl styrene, vinyl acetate, butyl acrylate, styrene, methacrylic acid, vinylbenzyl chloride and combinations of two or more of the foregoing. Preferred resinous particles comprise a polymer containing from about 65 to about 90 percent by weight vinylidene chloride, preferably from about 65 to about 75 percent by weight vinylidene chloride, and from about 35 to about 10 percent by weight acrylonitrile, preferably from about 25 to about 35 percent by weight acrylonitrile. The center of the expandable microspheres may include a volatile fluid foaming agent which is preferably not a solvent for the polymer resin. A particularly preferred foaming agent is isobutane which may be present in an amount ranging from about 10 to about 25 percent by weight of the resinous particles. Upon heating of the expandable microspheres to a temperature in the range from about 80 C to about 190 C in the dryer unit of papermaking machine, the resinous particles expand to a diameter ranging from about 0.5 to about 50 microns. Example of the Expandable microsphere compositions, their contents, methods of manufacture, and uses can be found in U.S. Pat. Applications, Ser. No. 60/926,214 filed on Apr. 25, 2007 entitled "Expandable Microspheres and Method of Making and Using the Same", as well as those having U.S. Publication Numbers, 2007/0044929-A1; 2006/0231227-A1; 2001/0044477; 2003/0008931; 2003/0008932; and 2004/0157057, which are hereby incorporated, in their entirety, herein by reference. Further references can be found, in U.S. Pat. Nos. 3,615,972; 3,864,181; 4,006,273; 4,044,176; and 6,617,364 which are hereby incorporated, in entirety, herein by reference. The amount of microspheres is usually from about 0.001 to 10.0% by weight. In the preferred embodiment the amount is from about 0.001 to about 5.0% by weight. For example in the preferred embodiment of the invention the amount of expandable microspheres may be 0.001, 0.002, 0.005, 0.01, 0.02, 0.05, 0.1, 0.2, 0.5, 1.0, 1.5, 2.0, 2.5, 3.0, 3.5, 4.0, 4.5 wt % based on total weight of the substrate, and including any and all ranges and subranges therein. Preferably, the amount of expandable microspheres used in the practice of this invention is from about 0.01 to 1.0 wt % dry basis expanded synthetic polymer microspheres based on total weight of the substrate, in from about 0.05 to about 0.5 when the embodiment of choice.

Conventional pulp preparation (cooking, bleaching refining, and the like) and papermaking processes may be used to form paperboard substrates from the furnish. However, one aspect of the invention is that the low density substrate containing expanded microspheres is preferably produced in such a manner as to exhibit a minimum average internal bond (average of CD and MD internal bond) in conjunction with its decreased density and increased caliper in relation to conventional paperboard used to make insulative containers such as paper cups or reduced density folding carton. To this end, those of ordinary skill of art are aware of various measures that alone or in combination may be taken to increase the internal bonding strength properties of paperboard substrate for a given basis weight. These include, but are not limited to, increasing the addition of wet and/or dry strength agents such as melamine formaldehyde, polyamine-epichlorohydrine, and polyamide-epichlorohydrine for wet strength and dry strength agents such as starch, gums, and polyacrylamides for dry strength in the furnish, increasing the refining of the pulp, and increased pressing of the wet substrate in the press section of the paper machine. In addition to improving internal bond, increased wet pressing also reduces the moisture in the substrate and allows the paperboard to be dried at a faster speed than otherwise possible.

According to the invention, it is preferred that measures be taken sufficient to maintain a minimum average internal bond of at least about $100\times10^{-3}$ ft-lbf. These measures are preferred, at least in regard to cup stock carrying a conventional weight of barrier coating applied in a conventional manner on one or both of its surfaces. However, the minimum internal bond strength may be relaxed somewhat for the heavier weight barrier coatings applied at the middle-upper end of the conventional 0.5 to 3.5 mil range of coating thicknesses. For example, at barrier coating thicknesses above about 1.5 mil, a minimum internal bond of about $80\times10^{-3}$ ft-lbf is believed to be sufficient for acceptable converting performance. Also, reduction in the extrusion processing speed in the order of about 25 percent allows relaxation of the internal bond requirement to about the same minimum level. Among the various approaches for increasing average internal bond, it is preferred to accomplish the desired increase of the average internal bond by increasing the refining of the pulp furnish, increasing the level of internal starch, dry strength additives, and the wet pressing of the wet substrate during papermaking to a level below substrate crushing, and increasing the amount of starch and other materials applied to the surface of the paper substrate as is done, for example, at the size press.

The inclusion of expandable microspheres in the papermaking furnish in an unexpanded state has the effect of lowering the apparent density of the resulting dried paperboard. However, it has been found that reducing the density of paperboard by inclusion of expanded microspheres adversely affects the convertibility of the paperboard into cups and other containers such as folding cartons. In accordance with the invention, it has been determined that low density paperboard products containing expanded microspheres produced in a relatively narrow range of densities and calipers in conjunction with the above-mentioned increased internal bond provides the physical properties necessary for processability in various converting operations. Reduction of the amount of expandable microspheres improves the convertability of the insulated cup stock but reduces the insulating characteristics. The present invention allows the same density to be achieved with fewer expandable microspheres, while exhibiting good convertibility properties, print quality, and other advantages.

For example, Table 1 shows that the addition of expandable microspheres without using a press belt improves paperboard substrate properties.

TABLE 1

| Properties | With Exp. Microspheres | Control (No Exp. Microspheres) |
|---|---|---|
| Print Mottle (scanner) | 2.74 | 3.43 |
| Print Texture | 3.0 | 3.0 |
| PPS | 1.44 | 1.65 |
| Sheffield | 19.3 | 32.8 |
| Print gloss 60° | 36.0 | 33.6 |
| Print gloss 60°(w/coating) | 50 | 48 |
| BW, stiff, Glue | 229 | 236 |

For example, Table 2 shows an improvement in expancel efficiency and allowing a user to make up the stiffness losses (MD and CD average stiffness) seen at the higher levels and improves paperboard properties without stiffness losses.

TABLE 2

| PRODUCTION/ TRIAL DESCR | CALIPER AVG | BASIS WEIGHT AVG | STIFFNESS MD AVG | STIFFNESS CD AVG | GEOMETRIC MEAN STIFF | STIFFNESS INDEX |
|---|---|---|---|---|---|---|
| YTD | 23.9 | 255.3 | 466.4 | 215.9 | 317.4 | 19.1 |
| HB FC Trial #1 @ 5.0 #/T | 24.1 | 240.0 | 422.8 | 195.5 | 287.5 | 20.8 |
| HB FC Trial #1 @ 10.0 #/T | 24.0 | 227.1 | 391.0 | 171.0 | 258.6 | 22.1 |
| HB FC Trial #2 @ 1.0 #/T | 23.8 | 251.2 | 454.5 | 210.0 | 308.9 | 19.5 |
| HB FC Trial #2 @ 2.0 #/T | 24.0 | 247.0 | 450.0 | 213.0 | 309.6 | 20.6 |
| ESP Trial #4 @ 3.0 #/T | 24.0 | 244.6 | 429.5 | 206.0 | 297.5 | 20.3 |

In terms of other physical properties needed for cup manufactures, low density paperboard substrates according to this invention also preferably have a minimum tensile strength as determined by Tappi Standard Test T of about 30 lbf/in, a minimum value for the average CD stretch of the substrate as determined by Tappi Standard Test T494 of about 3.3 percent.

It is an additional aspect of the invention that the low density paperboard has a roughness of less than or equal to 300 on the Sheffield smoothness scale, while exhibiting comparable print quality in a flexo printing operation. The printability of the paperboard is quite unexpected since conventional paperboard such as cupstock is ordinarily calendered down to a caliper of about 20 mil in order to achieve a surface smoothness (uncoated) generally in the order of about 125 to about 200 SU (from a pre-calendered smoothness in excess of 400 SU) believed necessary for acceptable print quality. Similarly the compressiblity of a coated or uncoated paperboard containing expandable microspheres also improves the lithographic and gravure printability at a constant roughness. While we do not wish to be bound by any theory, it is believed that the printability of the paperboard is attributable to its relatively high compressibility, which enables improved performance on flexographic and lithographic printing machines.

Coated paperboard is produced using a single ply or multiply paperboard produced with known fiber types including bleached/unbleached, softwood, hardwood, recycled and mechanical fibers, and other natural and synthetic fibers. The chemistry of the papermaking operations may be acid or alkaline and can involve a variety of known chemicals for achieving functional properties such as sizing, strength, optical properties such as opacity, brightness, oil, grease resistance etc. The present invention includes the addition of expandable microspheres at a dosage rate in the range of 1-20 lb/ton. The addition can be done at several points in the wet end section of the paper making process, including but not limited to, machine chest, stuff box, suction of the fan pump, and other possible locations. In the case of the multiply paperboard, the microspheres are preferably added to one or more plies in the interior of the substrate. Retention chemicals such as polacrylamides and PEI can be used to ensure that the microspheres are retained in the wet paperboard. The wet formed paper substrate is pressed in press section containing one or more press belts. The paper substrate is then dried in a drying section, which may contain, cylinder drying, condebelt drying, IR or other drying mechanisms. The paperboard is dried to a moisture level less than 10%. The paperboard may then be passed through a size press, which can be a puddle mode size press (inclined, vertical, horizontal) or metered size press (blade metered, rod metered or other forms of metering size presses). The size press operation would apply a number of possible binders including but not limited to starches of various forms (oxidized, cationic, ethylated, hydroexthylated & other starches), polyvinyl alcohol, polyvinylamine, alginate, carboxymethyl cellulose etc. The size press composition may include organic and inorganic pigments and other functional additives. The preferred method of size press application will restrict the binder to penetrate to less than 10% of the thickness from the outside edges. The paperboard with starch is then dried to a moisture level of less than 10% before it is calendered. The calendering can be performed in a variety of calendering processes including wet and dry stack calendering, steel nip calendering, hot soft calendering or extended nip calendering or a process such as microfinishing where frictional processes are used to finish the surface. The target paperboard is finished to a target smoothness of less than 180 Sheffield Units. The smooth paperboard can then be coated in an off-machine or on-machine coating process. The preferred method would be an inline coating process with one or more stations. The coating stations can be any of the known coating processes including, brush coating, rod coating, air knife coating, spray coating, blade coating, transfer roll coating, reverse roll coating and cast coating. The coated product is dried in normal drying operations and finished in one or more finishing stations such as a gloss calender, soft nip calendar or extended nip calender. The final coated product has the following specifications:

Density: 8-12.0 lbs/3MSF/mil

PPS 10 Kgf/cm$^2$: <1.5 microns

Sheffield Smoothness<20 SU

Further, the above coated paperboard when tested in a commercial offset press will show a reduction in print mottle, where the reduction can range from 10%-50% compared to a control paperboard produced without expandable microspheres in the basestock.

Previously, we had conducted a trial to determine if a small quantity of expandable microspheres could be added to the furnish of the paper machine in order to reduce basis weight or improve the print quality. Levels of 5 lb/ton and 10 lb/ton of expandable microspheres showed some print quality and surface smoothness improvement, but with reduced stiffness. Levels of 1 and 2 lb/ton did not reduce stiffness, but did not yield a significant improvement in print quality or an economically feasible method of reducing basis weight.

In general, the present invention is directed to solve problems related to a) improved machine speed and/or reduced cost/ton, b) improved surface quality, and c) improved print quality. All of these problems are solved without sacrificing stiffness of the paperboard. It should be noted that solutions to any of the above problems offer a competitive advantage. One advantage is to increase machine speed. If expandable microspheres can be substituted for fiber, so that to get bulk (Z-directional thickness) with a reduced amount of fiber, then the paper machine speed can be increased and the cost of fiber per ton can be reduced. It was noted that the combination of a pulp furnish containing expandable microspheres used with a press belt results in an unexpected increase in expandable microspheres efficiency. The combination of a pulp furnish containing expandable microsphere allowed the amount of expandable microsphere to be reduced to the lowest level ever recorded during an insulated cup run on the paper machine. Prior to the insulated cup run, operation with the press belt without expandable microspheres resulted in slightly improved paperboard smoothness. It is noted that the reduced roughness of the unexpanded paperboard resulted in more uniform heat transfer distribution to the expandable microspheres. The improved expansion efficiency of microsphere is resulted in lower density of paperboard than previously achieved. Since the insulative value of the insulated cup stock is proportional to the paperboard density, and then this is resulted in a more efficient manufacturing capability. The improved expansion of the microspheres efficiency also results in a reduced cost product. The percentage of expandable microspheres used has a significant impact on the total cost of the finished paperboard and its products. Since less expandable microspheres are used, therefore there is improved fiber to fiber bonding which helps to promote the strength of the substrate.

The unexpected decrease in the amount of expandable microspheres needed to achieve target paperboard densities came from the improved smoothness which is allowing greater contact area between the substrate and the dryer device. The parts of the substrate in intimate contact with the dryer device are heated by conduction. But those parts that are near the dryer, but not touching the dryer device, are heated by convection. Since convection heat transfer is less efficient than conduction heat transfer, then the expansion of expandable microspheres needs to occur while there is sufficient moisture available in the paperboard or substrate. If the substrate has been dried to a low level of moisture where the expandable microspheres reach their expansion temperature, then they will not have sufficient force to displace the fibers. If this occurs, then the caliper will not increase or the paperboard density will not decrease as well. Therefore, substrate expansion needs to occur while the paperboard fiber mat still has enough moisture to provide lubricity between the fibers.

Paperboard without expandable microspheres is not subject to this defect and can be dried to target moisture levels by increasing the effective drying length of the dryer section (such as slowing down, increasing steam or adding more dyers).

Expandable microspheres begin to expand when the local temperature reaches the softening temperature of the thermoplastic shell. The gas heated in the center of the expandable microspheres and then expands the plastic sphere diameter. For a given polymeric construction of expandable microspheres, the temperature for expansion begin to varies slightly depending upon the expandable microspheres shell thickness and the quantity of gas in the interior of the expandable microspheres. Any batch of expandable microspheres will begin to expand over a range of temperatures. If the local substrate temperature in a cross machine direction (CD) strip in contact with a dryer is uniform, then all the expandable microspheres with a given expansion temperature in the strip should expand at the same time. This results in a uniform increase of the paperboard thickness in the heated CD strip. As the temperature of the substrate continues to increase as it passes through the dryer section, more of the expandable microspheres with higher expansion temperatures will expand uniformly. Given an initial uniform substrate topography and uniform contact with the dryer device, the substrate should expand uniformly, and all areas of the substrate will remain in contact with the dryer devices and will continue to be heated by more efficient conduction heat transfer. If a substrate containing expandable microspheres has non-uniform topography, then the low areas will not be in contact with the dryer devices. These areas will be heated more slowly by convective heat transfer, and their temperature will remain lower than the high areas which are in intimate contact with the dryer devices that are heated by conduction heat transfer. Since this is a transient heat transfer situation, increasing the down stream temperature will not compensate for locally reduced temperatures during the initial drying phases. Once the local temperature is depressed it will tend to remain depressed. Therefore the high areas will reach the expansion temperature before the low areas and they begin to expand before the low areas. With normal topography variations this can be overcome by increasing the amount of expandable microspheres used so that all areas are likely to contain more of the expandable microspheres with lower than average expansion temperatures. This results in increased product costs and reduced expandable microsphere efficiencies. If the paperboard surface topography is very rough, the variation in local temperatures can cause an unacceptable defect known as "Leopard spots" that cause excessive caliper variations at times up to 50% of the final paperboard thickness.

FIG. 1 is a paper making machine assembly that is used to make paperboard in accordance to the preferred embodiment of the invention. The paper making machine 10 includes a flow spreader 12, a head box 14, fourdrinier or twin wire table 16, press section 18, dryer section 20, calendering stack 22 and reel 24. Paper stock of the type described above, is fed to flow spreader 12 via pipeline 26 from a pulp stock storage tank (not depicted). Flow spreader 12 distributes pulp stock flow evenly across the latitudinal axis of the paper making machine 10. The evenly distributed pulp stock flow is introduced into the head box 14 which discharges a uniform jet of paper making stock onto the moving forming wire of the fourdrinier forming table 16. The forming wire is a porous woven support surface which moves along an endless path of travel entrained over various rollers 28. The forming wire forms the fiber into a continuous matted substrate 30 while the fourdrinier forming table 16 drains the water from the paper substrate by suction force. The wet paper substrate 30 then passes through the press section 18 through a series of roll presses 19 where generally additional water is removed and the paper substrate structure is consolidated. The consolidated paper substrate 30 is then conveyed to dryer section 20 where the paper substrate 30 is dried by contact with a series of steam heated devices or cylinders 32 which remove most of the remaining water by evaporation and develop fiber-to-fiber bonds. The dried substrate of paper substrate 30 is conveyed to calender stack 22 where the dried paper substrate 30 is calendered through a series of roll nips which reduces paper substrate thickness and increases paper substrate 30 smoothness. The dried, calendered paper substrate or substrate is then accumulated by winding onto reel 24.

The pressing of the paper substrate 30 is generally carried out in contact with a felt (not shown) between two conventional rolls in the press section 18. The felt is generally comprises of a coarse base weave in one, two, or three layers of different designs and coarseness levels. The paper substrate 30 and the felt are pressed between two rotating rolls. Generally in a conventional press section, the paper substrate 30 that is in contact with the felt undergoes a compression. Water flows out of paper substrate 30 into the felt and when the felt is saturated with water, the water then moves out of the felt. After the press section, the paper substrate goes in the drying section 20 of the paper making machine 10.

Figure 2:
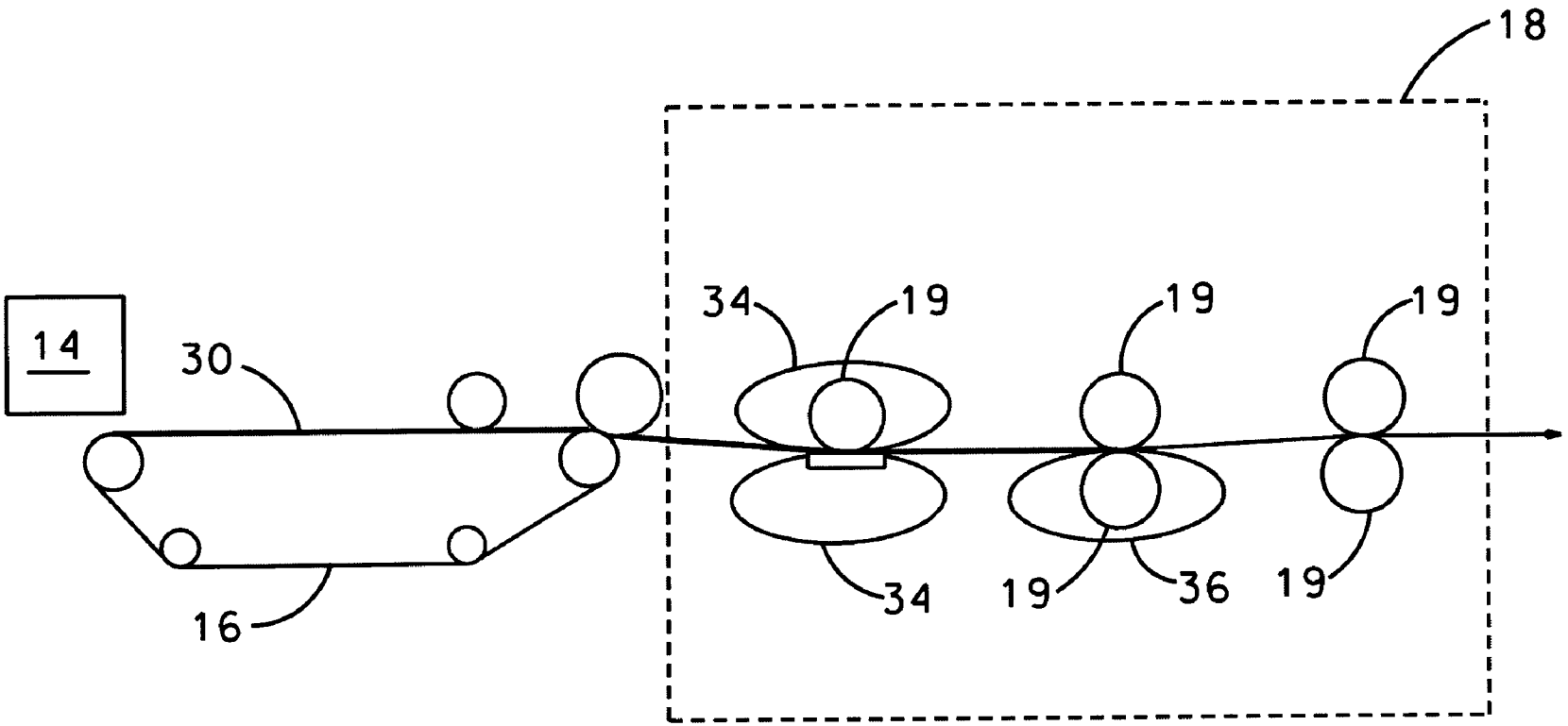
FIG. 2 is a portion of FIG. 1 illustrating a detail configuration of the press section shown a plurality of press belts.

FIG. 2 illustrates a preferred embodiment of the present invention in which at least one of the press felt 34 is replaced by a press belt 36. The press belt 36 is generally made of a smooth rubber, which depending on the design, may be permeable, semi-permeable, or entirely impermeable. The press belt 36 may also be made of other materials as well. The paper substrate 30 is in contact under compression from both sides by press belt 36. During compression of the paper substrate 30 by the two rollers 19, the water in the paper substrate 30 is uniformly distributed within the thickness of the paper substrate 30 and when the paper substrate 30 moves to the drying section (not shown), there is much more efficient heat transfer interaction between the paper substrate 30 and the drying devices 20 that is shown in FIG. 1. In the drying section 20, the water in the paper substrate 30 is evaporated at an efficient rate and low steam usage.

The present invention discovers that using the press belt 34 in place of press felt 32 causes uniform distribution of expanded microspheres across the paper substrate 30. The evaporation rate is greatly influenced by the steam pressure used inside the drying cylinder. Therefore, evaporation of the remaining water in the paper substrate 30 causes the microspheres to expand uniformly across the thickness of the paper substrate 30. The uniform expansion of the microspheres permits paper substrate 30 to remain bulky and also reduces the amount of microspheres initially added to the fiber. In addition, the present invention discovers that by using the press belt 34, the amount of microspheres is substantially reduced without negatively affecting the stiffness or caliper of the paper substrate 30. The press section 18 shown in FIGS. 1 and 2 is exemplary, and various design of press section 18 having at least one press belt 34 may be used without departing from the scope of the present invention. Generally depending on the design, a paper substrate may moves through at least one stage or preferably two stages, or most preferably more three stages in the press section before entering the drying section. However, it should be noted that regardless of the number of stages in the press section, at least in one of the stages within a press section, a press belt should be used in place of press felt in accordance to the preferred embodiment of the present invention.

Figure 3:
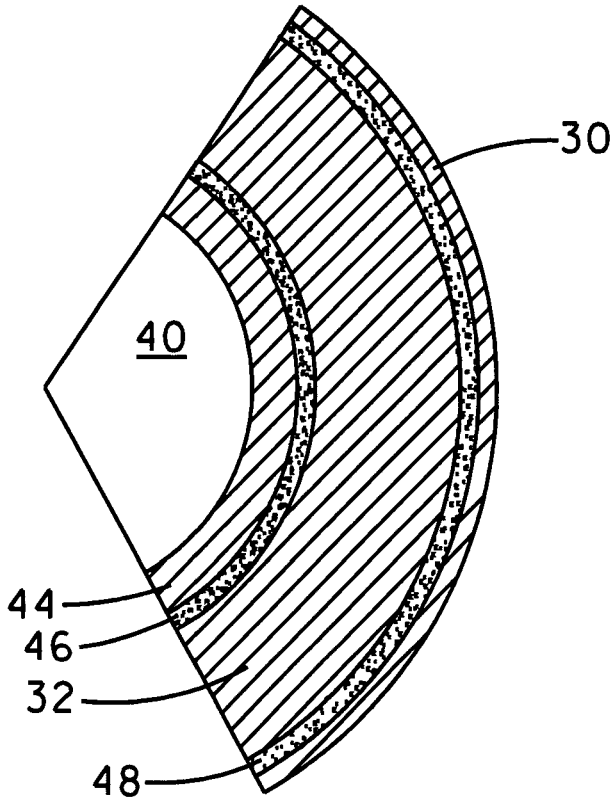
FIG. 3 is a sectional view of a portion of a dryer device and a paperboard substrate illustrating the detail of temperature profile between the paperboard substrate and the dryer device.

FIG. 3 illustrates the temperature profile between steam 40 and the paper substrate 30 in the dryer cylinders 32. The various resistances to heat transfer from inside the dryer cylinder is listed accordingly. The major resistances are usually provided by the condensate layer 44 inside the cylinder 32, the dirt film 46 on the outer surface, and the air layer 48. As shown in FIG. 2, the parts of the paper substrate 30 in intimate contact with the dryer device 32 are heated by conduction. But those parts that are near the dryer device 32, but not touching the dryer device 32, are heated by convection. Since convection heat transfer is less efficient than conduction heat transfer, then the expansion of expandable microspheres needs to occur while there is sufficient moisture available in the paper substrate 30. If the paper substrate has been dried to a low level of moisture where the expandable microspheres reach their expansion temperature, then they will not have sufficient force to displace the fibers. If this occurs, then the caliper will not increase or the paper substrate 30 density will not decrease as well. Therefore, paper substrate expansion needs to occur while the substrate fiber mat still has enough moisture to provide lubricity between the fibers.

Figure 4:
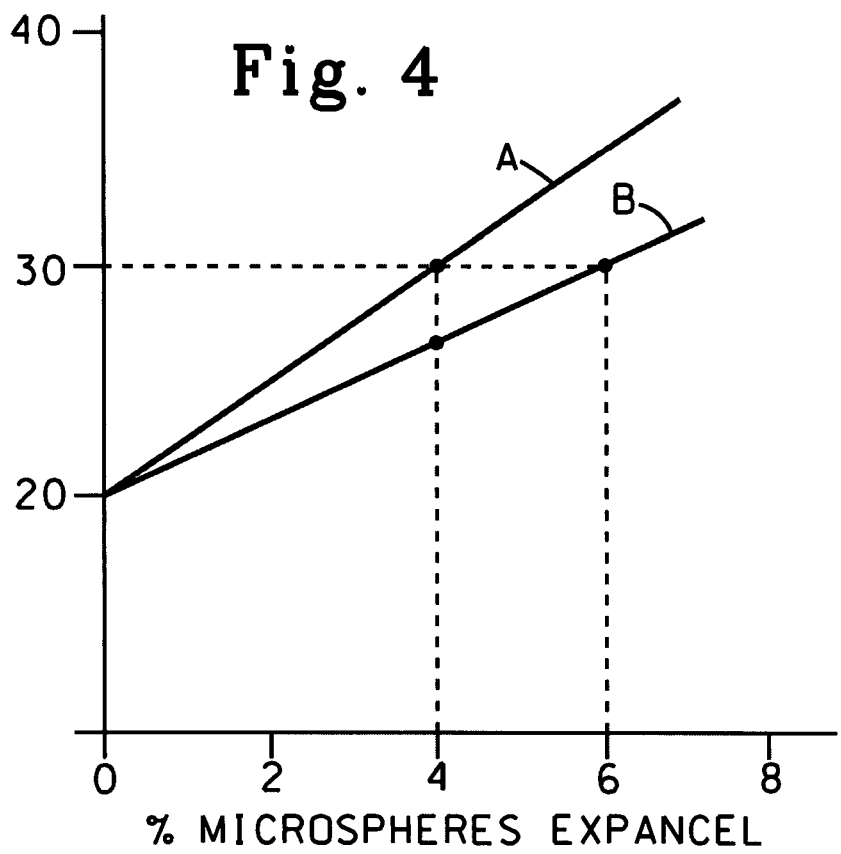
FIG. 4 is a graph illustrating changes in caliper and expandable microspheres of a paperboard substrate used with a press felt and without a press belt.

FIG. 4 is a graph illustrating changes in caliper and expandable microspheres of a paperboard substrate used without the press belt 34 (e.g., using the press felt 36) and with the press belt 34 discussed above. In the graph, line A depicts various changes of microshperes versus caliper of a nominal 20 points of the paper substrate 30 with the press belt 34. Line B depicts various changes of microshperes versus caliper of a nominal 20 points of the paper substrate 30 without the press belt 34 (using the press felt 36). The experiment conducted with the press felt 36 and the press belt 34 for 200 basis weight of fiber. It was discovered that the amount of microshperes can be substantially reduced by using a press belt 34. In fact, the stiffness of the paper substrate is also positively impacted as shown in the following table.

| | Press type | |
|---|---|---|
| | Belt | Felt |
| BW (lb/ream) | 224 | 241 |
| Expandable Microsphere Flow (GPM) | 8.9 | 9.0325 |
| Machine Speed (FPM) | 734 | 676 |
| Taber Stiffness MD AVG | 303 | 261 |
| Taber Stiffness CD AVG | 182 | 168 |

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A paper or paperboard substrate comprising:

cellulosic fibers and from about 0.05 to about 0.15 wt. % dry basis synthetic polymer microspheres based on total weight of the substrate dispersed in the cellulosic fibers, the substrate including the synthetic polymer microspheres has a density about the same as a density of a substrate without having the synthetic polymer microspheres when compared, the substrate having at least one surface suitable for printing wherein the surface has a Parker smoothness less than about 5.0, a Hagerty/Sheffield smoothness of less than about 180 Sheffield units or a combination thereof.

2. The paper or paperboard substrate of claim 1 wherein the at least one surface of the substrate includes pigmented coatings and coating binders that provides a coating surface having a Parker smoothness less than about 2.0 and a Hagerty/Sheffield smoothness of less than about 120 Sheffield units.

3. The paper or paperboard substrate of claim 2 wherein the pigments are selected from the group consisting of calcium carbonates, clay, plastic pigments, titanium oxide, calcined clay, satin white, silica, alumina silicates, talc, aluminum trihydrates and polymethyl methacrylate beads, and the coating binders are selected from the group consisting of latex, PVAc, protein and cassine.

4. The paper or paperboard substrate of claim 1 wherein the substrate have a caliper of from about 10 to about 28 mil.

5. The paper or paperboard substrate of claim 1 wherein the substrate have an apparent density of from about 8.0 to about 12 lb/3MSF/mil.

6. The paper or paperboard substrate of claim 1 wherein the substrate has enhanced stiffness properties.

7. The paper or paperboard substrate of claim 1 wherein the substrate has a basis weight in a range of 100 to 350 pounds per 3,000 square feet.

8. The paper or paperboard substrate of claim 1 wherein the substrate is made of a fibrous substrate formed on a fourdrinier wire by depositing a mixture of aqueous slurry of cellulosic fibers and the expanded synthetic polymer microspheres thereon from a headbox and removing water from the cellulosic fibers to produce the fibrous substrate and then pressing the fibrous substrate to reduce the moisture content thereof to at least about 60% by weight of water.

9. The paper or paperboard substrate of claim 8 wherein the fibrous substrate is pressed by the press belt.

10. The paper or paperboard substrate of claim 8 wherein the fibrous substrate is pressed by the press felt.

11. The paper or paperboard substrate of claim 8 wherein the fibrous substrate is pressed by a combination of the press belt and the press felt.

12. The paper or paperboard substrate of claim 8 wherein the fibrous substrate is subjected to pressure and heat to cause evaporation of water from the fibrous substrate to thereby reducing the moisture content of the fibrous substrate to below about 40% by weight of water.

13. The paper or paperboard substrate of claim 8 wherein the fibrous substrate is conveyed through a press section of a paper machine and at least one of the press sections contains a semi-pervious press belt.

14. The paper or paperboard substrate of claim 13 wherein the synthetic microspheres in the fibrous substrate expand upon heating thereof such the expanded synthetic microspheres force the cellulosic fibers apart and thereby increasing the bulk of the fibrous substrate.

15. A paperboard product having a basis weight in a range of 100 to 350 pounds per 3,000 square feet and comprising at least one coated surface suitable for printing wherein the at least one coated surface comprising cellulosic fibers and from about 0.05 to about 0.15 wt. % dry basis synthetic polymer microspheres based on total weight of the of cellulosic fiber dispersed thereof, the substrate including the synthetic polymer microspheres has a density about the same as a density of a substrate without having the synthetic polymer microspheres when compared, and wherein the coated surface has a Parker smoothness less than about 2.0, a Hagerty/Sheffield smoothness not less than about 20 Sheffield units or a combination thereof.

16. A method for making a paper or paperboard substrate comprising:

providing a papermaking furnish containing cellulosic fibers and from about 0.05 to about 0.15 wt % by weight dry basis expanded or expandable microspheres wherein the substrate including the synthetic polymer microspheres has a density about the same as a density of a substrate without having the synthetic polymer microspheres when compared;

forming a fibrous substrate from the papermaking furnish;

increasing smoothness of a paperboard substrate by moving the fibrous substrate through at least one press belt or press felt device or combination thereof to form a pressed paperboard substrate;

increasing heat transfer rate between the pressed paperboard substrate and a drying device of a paper machine by using the press belt or the press felt; and reducing the amount of the expanded polymeric microspheres used in the paperboard substrate.

* * * * *